United States Patent [19]

Lipperts

[11] 4,109,122

[45] Aug. 22, 1978

[54] VACUUM SWITCH WITH INTERMITTENTLY ENERGIZED ELECTROMAGNETIC COIL

[75] Inventor: Joseph H. F. G. Lipperts, Hengelo (O), Netherlands

[73] Assignee: Hazemeijer B.V., Hengelo (O), Netherlands

[21] Appl. No.: 773,273

[22] Filed: Mar. 1, 1977

[51] Int. Cl.[2] ..... H01H 33/66

[52] U.S. Cl. ..... 200/144 B; 200/147 R

[58] Field of Search ..... 200/144 B, 147 R

[56] References Cited

U.S. PATENT DOCUMENTS

| | | | |
|---|---|---|---|
| 2,729,723 | 1/1956 | Pristsak | 200/147 R |
| 2,820,122 | 1/1958 | Teszner | 200/147 R |
| 3,185,797 | 5/1965 | Porter | 200/144 B |
| 3,845,263 | 10/1974 | Dickinson | 200/144 B |
| 4,021,628 | 5/1977 | Kimblin | 200/144 B |

*Primary Examiner*—Robert S. Macon

*Attorney, Agent, or Firm*—Watson, Cole, Grindle & Watson

[57] ABSTRACT

An evacuated envelope contains two stationary contact elements which have an gap therebetween, and positioned within the gap are two metal discs separated by an insulating disc. Each metal disc is connected to a terminal coil which is connected to an electromagnetic coil operative to produce a magnetic field in the region of the gap and substantially in parallel with the width of the gap. A U-shaped contact element is positioned with the envelope to move into and out of contact with each of the stationary contact elements. The stationary contact elements are each connected to separate contact rods which extend through the envelope walls to the outside.

6 Claims, 4 Drawing Figures

VACUUM SWITCH WITH INTERMITTENTLY ENERGIZED ELECTROMAGNETIC COIL

BACKGROUND OF THE INVENTION

The present invention relates to a vacuum switch which comprises an evacuated envelope having therein two contact elements having an electrically insulating gap therebetween, and an electromagnetic coil operative to produce a magnetic field in the region of the gap between the contact elements, the magnetic field being substantially parallel to the width of the gap. A vacuum switch of this kind is known from British patent specification No. 1,258,015.

The known vacuum switch is provided with an electromagnetic coil surrounding the envelope of the vacuum switch, one of the terminals of the coil being connected to a movable contact element of the vacuum switch so that the other stationary element of the switch and the other terminal of the coil can be used to connect the vacuum switch in a current circuit to be protected. The coil is connected in series with two contact elements and when an electric current flows through the vacuum switch, and thus also through the coil, the coil produces an axial magnetic field, i.e., a magnetic field which during current interruption is parallel to the width of the gap between the contact elements and parallel to the arc to be interrupted between the contact elements. The magnetic field increases the current-interruption capability of the vacuum switch. With the known vacuum switch, the coil is continuously energized, i.e., even when the switch is in a closed condition during which the magnetic field is not required. This leads to additional Joule losses in the coil and consequently to an additional temperature rise of the vacuum switch such that the current-carrying capacity of the vacuum switch is lower than required.

SUMMARY OF THE INVENTION

It is the object of this invention to provide a vacuum switch in which the coil is energized only during the process of interruption, i.e., when the contact elements are opened and when an electric arc generated therebetween. To this end, a vacuum switch according to the invention comprises an evacuated envelope having therein two stationary contact elements having an electrically insulating gap therebetween, and an electromagnetic coil operative to produce a magnetic field in the region of the gap between the contact elements, the magnetic field being substantially parallel to the width of the gap, wherein terminals of the coil are respectively connected to two metal discs separated from each other by means of an electrically insulating disc, and an assembly comprising the insulating disc and the two metal discs on either side thereof being mounted within the gap between the two stationary contact elements, in the closed condition of the switch the contact elements being bridged by a third movable U-shaped contact element of the switch.

In a first preferred embodiment, the coil is mounted on the outer side of the envelope whilst the coil terminals pass into the envelope through a sealing insulator forming part of the wall of the envelope.

In a second preferred embodiment of the present invention, the envelope comprises a metal cylinder having an insulating strip inserted in the wall of the cylinder which acts as the electromagnetic coil subtending almost 360° at the centre of the cylinder, one terminal of the coil being constituted by an electrical conductor interconnecting one of the metal discs and an area of the metal cylinder immediately adjacent one side of the insulating strip and the other terminal being constituted by a further electrical conductor interconnecting the other metal disc and an area of the cylinder immediately adjacent the other side of the insulating strip.

The second embodiment of the present invention has the advantage that a separate coil can be omitted as its function is fulfilled by part of the envelope, i.e. the metal cylinder.

An additional advantage of disposing the assembly comprising the two metal discs and the insulating disc within the gap between the two contact elements is that the maximum arc voltage decreases during the process of interruption, as a result of which the interruption capability of the vacuum switch is increased, see publication by Mitchell, "High Current Vacuum Arc", in Part I, "An Experimental Study", Proceedings I.E.E., Vol. 117, No. 12, Dec. 1970, pages 2315 up to 2326 inclusive.

DESCRIPTION OF THE DRAWINGS

The invention will now be further described, by way of example, with reference to the accompanying drawings, wherein.

DESCRIPTION OF THE PREFERRED EMBODIMENTS

Figure 1:
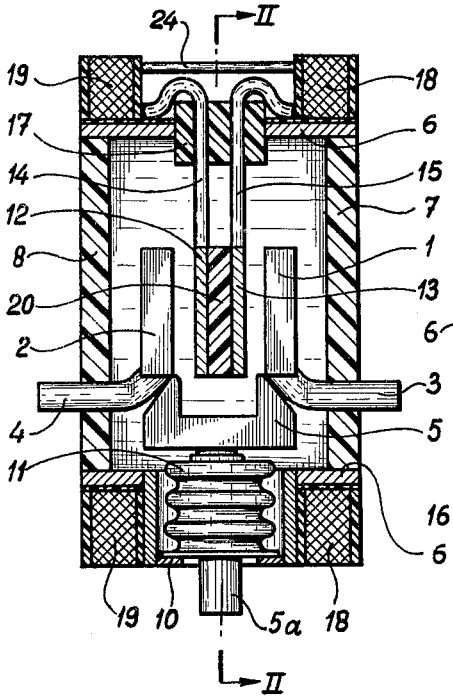
FIG. 1 is a sectional view of a first embodiment of vacuum switch in accordance with the present invention.
Figure 2:
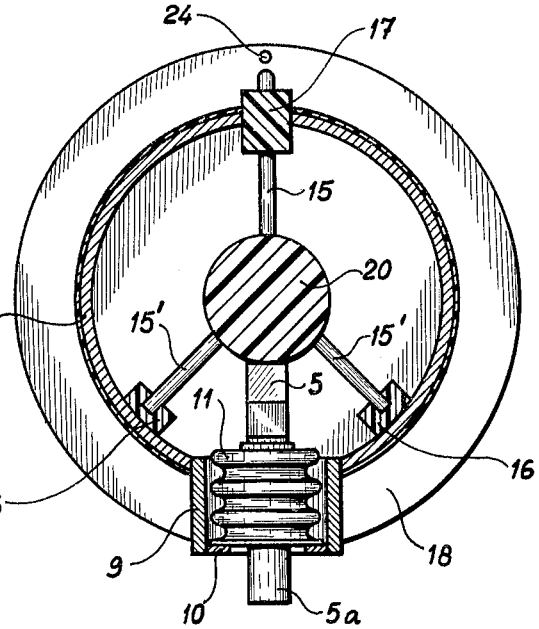
FIG. 2 is a sectional view taken on the line II—II of FIG. 1.

As is apparent from FIGS. 1 and 2, the vacuum switch is provided with an evacuated, hermetically sealed envelope, the envelope being composed of a metal cylinder 6 and two insulating discs 7, 8. Two stationary contact elements 1, 2 are mounted within this envelope, the elements 1, 2 being secured by means of supports or contact rods 3 and 4 respectively. The supports 3, 4 pass in a vacuum-tight manner through the insulating disc 7 and 8 respectively to the outside. The vacuum switch is provided with an electromagnetic coil comprising two winding 18, 19 connected to each other by means of a conductor 24, whilst the two coil terminals 14, 15 extend through an insulator 17 and into the envelope, the insulator 17 being mounted in the metal cylinder 6. The terminals 14 and 15 are connected to metal discs 12 and 13 respectively, an insulating disc 20 being disposed between the disc 12 and 13. The assembly consisting of the disc 12, 13 and 20 is mounted in the centre of the insulating gap between the contact elements 1 and 2 and is held by the terminals 14 and 15 as well as by metal rods 15', and rods 15' being secured on the inner wall of the metal cylinder 6 by means of insulators 16.

The two stationary contact elements 1, 2 can be bridged by a U-shaped movable contact element 5 provided at the end of a contact rod 5*a*, the rod 5*a* extending in a vacuum-tight manner through the envelope by means of flexible bellows 11. The contact rod 5*a* can be moved up and down (with attendant movement of the flexible bellows) so that the stationary contact elements 1 and 2 can be bridged or separated. The flexible bellows 11 are disposed in a chamber 9 communicating with the interior of the metal cylinder 6, the chamber 9 being closed by an annular plate 10 through which the contact rod 5*a* passes.

FIGS. 1 and 2 illustrate the vacuum switch in a switched on condition. When the vacuum switch is to be opened, the contact rod 5*a* is pulled downwards by a control mechanism (not illustrated) as a result of which two arcs are first generated, i.e., between the contact rod 3 and the contact element 5 and between the contact rod 4 and the contact element 5.

Because of the U-shape of the contact element 5, both arcs will move upwards (see FIG. 1) and reach the space between the contact element 1 and the metal disc 13 and between the contact element 2 and the metal disc 12. The current will now flow through the contact rod 3, the contact element 1, via the arc between the contact element 1 and the metal disc 13, through the metal disc 13, the terminal 15, the winding 18, the conductor 24, the winding 19, the terminal 14, the metal disc 12, via the arc between the disc 12 and the contact element 2, through the contact element 2 and the contact rod 4. The two windings 18 and 19 are wound in the same sense and produce a magnetic field across the gap, i.e., perpendicular to the contact elements 1, 2 and parallel to the arcs in the gaps between the contact element 1 and the metal disc 13 and the contact element 2 and the metal disc 12. Thus the arc voltage will be reduced considerably.

When the vacuum switch has been switched on (see FIG. 1), the two windings 18, 19 are not energized so that no heat is developed therein.

Figure 3:
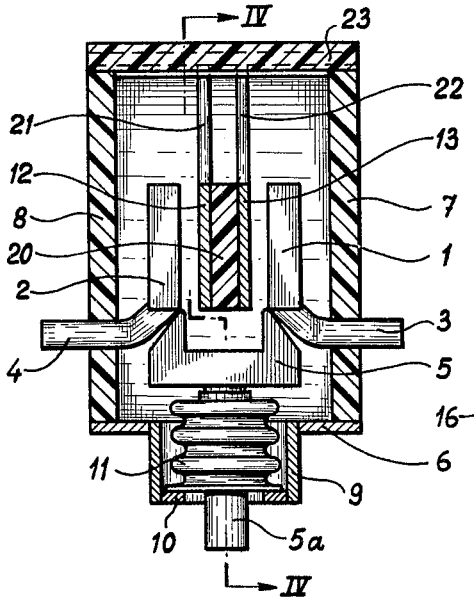
FIG. 3 is a sectional view of a second embodiment of vacuum switch in accordance with the present invention.
Figure 4:
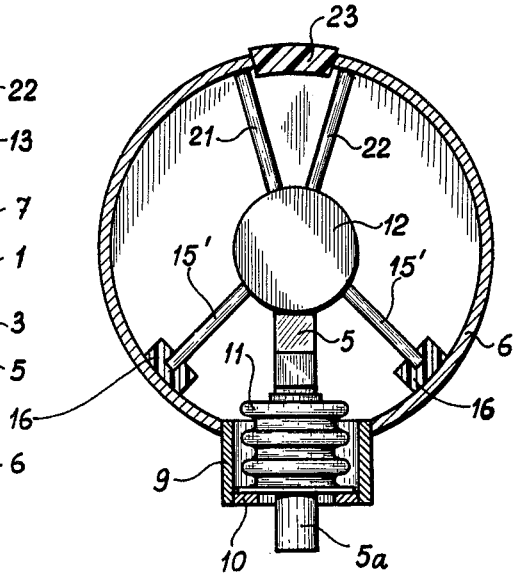
FIG. 4 is a sectional view taken on the line IV—IV of FIG. 3.

FIGS. 3 and 4 illustrate an alternative embodiment of the present invention. The envelope of the vacuum switch is again composed of a metal cylinder 6, now accommodating an axially extending insulating strip 23. The assembly of the cylinder 6 and the insulating strip 23 is sealed at each end by means of two insulating discs 7, 8. Two contact elements 1, 2 are disposed within the envelope, the elements 1,2 being supported by means of the contact rods 3 and 4 respectively. The contact rods 3, 4 extend outwardly in a vacuum-tight manner through the discs 7 and 8 respectively. The two contact elements 1, 2 can be bridged by a U-shaped movable contact element 5 mounted on a control rod 5*a*, the rod 5*a* extending outwardly in a vacuum-tight manner by means of a flexible bellows 11. The bellows 11 are disposed in a chamber 9 communicating with the interior of the metal cylinder 6, the chamber 9 being closed by an annular plate 10 through which the contact rod 5*a* passes.

In this embodiment the electromagnetic coil is constituted by the metal cylinder 6, the cylinder 6 being electrically interrupted by the insulating strip 23. Thus, the coil consists of almost one full turn. The terminals 21, 22 of the coil are secured to the metal cylinder 6 on either side of the insulating strip 23 and are connected to the metal discs 12 and 13 respectively. The discs 12, 13 are disposed on either side of an insulating disc 20. The assembly of the metal discs 12, 13 and the insulating disc 20 is suspended in the gap between the stationary contact elements 1, 2 and is held by two coil terminals 21, 22 and two metal supports 15'. The supports 15' are secured on the inner wall of the metal cylinder 6 by means of insulators 16.

The operation of the vacuum switch of FIGS. 3 and 4 is identical to the operation of the vacuum switch of FIGS. 1 and 2. During opening of the switch in which the movable contact 5 is pulled downwards over a certain distance, the current flow during the process of interruption is as follows: the contact rod 3, the contact element 1, via an arc towards the metal disc 13, through the terminal 22, the metal cylinder 6 (clockwise in FIG. 4) towards the other terminal 21, through the metal disc 12, via a second arc towards the other contact element 2 and finally via the other contact rod 4.

In the vacuum switch of FIGS. 3, 4 no current will flow through the coil, i.e., through the metal cylinder 6, in the switched-on condition of the switch.

What we claim is:

1. A vacuum switch which comprises:

an evacuated envelope;

two stationary contact elements mounted within said evacuated envelope such that an electrically insulating gap is formed therebetween;

an electromagnetic coil capable of producing a magnetic field in the region of said gap between said contact elements and substantially in parallel with the width of said gap;

two metal discs positioned with said gap between said contact elements, an electrically insulating disc separating said two metal discs, each of said two metal discs being supported by separate coil terminal means connected to said electromagnetic coil, and a movable U-shaped contact element mounted within said evacuated envelope such that the end portions of said U-shaped contact element are positionable to contact each of said two stationary contact elements and act to electrically bridge the gap therebetween.

2. The vacuum switch according to claim 1 wherein said electromagnetic coil is mounted on said evacuated envelope on the outside thereof, and wherein said separate coil terminal means extend into said evacuated envelope through a sealing insulator means which forms a part of said envelope.

3. The vacuum switch according to claim 1 wherein said envelope comprises a metal cylinder having a longitudinal wall and end walls; wherein an insulating strip is inserted along the longitudinal wall of said metal cylinder to create said electromagnetic coil which subtends almost 360° at the center of the cylinder; wherein said separate coil terminal means are connected to said metal cylinder, one of said separate coil terminal means being connected to said longitudinal wall a point immediately adjacent to one side of said insulating strip and the other of said separate coil terminal means being connected to said longitudinal wall at a point immediately adjacent the other side of said insulating strip.

4. The vacuum switch according to claim 1 wherein said two stationary contact elements are supported in said evacuated envelope by respective contact rods, and wherein said contact rods extend through said evacuated envelope in an air-tight fashion and in opposite directions.

5. The vacuum switch according to claim 1 wherein said movable U-shaped contact element is supported within said evacuated envelope by a contact rod, and wherein said contact rod extends through said evacuated envelope in an air-tight fashion.

6. The vacuum switch according to claim 5 wherein said evacuated envelope is formed to include an internal chamber wherein said contact rod supporting said U-shaped contact element extends through said chamber and through an opening in said evacuated envelope to the outside, and wherein a flexible bellows is connected to and positioned around said contact rod in said chamber to produce said air-tight seal between the inside of said evacuated envelope and the outside.

* * * * *

UNITED STATES PATENT OFFICE

CERTIFICATE OF CORRECTION

PATENT NO. : 4,109,122

DATED : August 22, 1978

INVENTOR(S) : Joseph H. F. G. Lipperts

It is certified that error appears in the above-identified patent and that said Letters Patent are hereby corrected as shown below:

[30] FOREIGN APPLICATION PRIORITY DATA

March 3, 1976 The Netherlands.....76.02209

Signed and Sealed this

*Third* Day of *April 1979*

[SEAL]

*Attest:*

RUTH C. MASON
*Attesting Officer*

DONALD W. BANNER
*Commissioner of Patents and Trademarks*